US007900400B2

(12) United States Patent
Liang et al.

(10) Patent No.: US 7,900,400 B2
(45) Date of Patent: Mar. 8, 2011

(54) ADJUSTABLE WINDOW HINGE

(75) Inventors: Luke Liang, So. Plainfield, NJ (US); Tong Liang, Guang Zhou (CN); David Chen, Guang Zhou (CN)

(73) Assignee: Vision Industries Group, Inc.

( * ) Notice: Subject to any disclaimer, the term of this patent is extended or adjusted under 35 U.S.C. 154(b) by 513 days.

(21) Appl. No.: 11/601,383

(22) Filed: Nov. 17, 2006

(65) Prior Publication Data

US 2008/0115321 A1 May 22, 2008

(51) Int. Cl.
*E05D 15/28* (2006.01)

(52) U.S. Cl. ..... 49/246; 49/250; 49/252; 49/396; 16/235; 16/242; 16/245

(58) Field of Classification Search ..... 49/246, 49/250–252, 396; 16/235, 242, 245
See application file for complete search history.

(56) References Cited

U.S. PATENT DOCUMENTS

| | | | | | |
|---|---|---|---|---|---|
| 2,541,567 | A | * | 2/1951 | Barrett | 16/245 |
| 3,092,097 | A | * | 6/1963 | Moss | 126/194 |
| 4,726,092 | A | | 2/1988 | Tacheny et al. | |
| 4,790,106 | A | * | 12/1988 | La See | 49/252 |
| RE32,846 | E | | 1/1989 | Sandberg et al. | |
| 5,040,267 | A | * | 8/1991 | Dallmann | 16/239 |
| 5,074,075 | A | * | 12/1991 | La See | 49/252 |
| 5,152,102 | A | * | 10/1992 | La See | 49/252 |
| 5,307,539 | A | * | 5/1994 | Bauman | 16/239 |
| RE34,657 | E | * | 7/1994 | La See | 49/252 |
| 5,491,930 | A | * | 2/1996 | La See | 49/252 |
| RE35,635 | E | * | 10/1997 | Bauman | 16/239 |
| 5,794,310 | A | * | 8/1998 | Dallmann | 16/362 |
| 5,964,011 | A | * | 10/1999 | Ruston et al. | 16/239 |
| 6,112,371 | A | * | 9/2000 | Tremblay | 16/362 |
| 6,134,751 | A | * | 10/2000 | Carrier et al. | 16/242 |
| 6,276,025 | B1 | * | 8/2001 | Leibman | 16/241 |
| 6,513,194 | B2 | * | 2/2003 | Harkins et al. | 16/239 |
| 6,643,896 | B2 | * | 11/2003 | Carrier | 16/242 |
| 7,257,864 | B2 | * | 8/2007 | Liang et al. | 16/366 |
| 2002/0108212 | A1 | * | 8/2002 | Carrier | 16/242 |

* cited by examiner

*Primary Examiner* — Jerry Redman
(74) *Attorney, Agent, or Firm* — Thomas A. O'Rourke; Bodner & O'Rourke, LLP

(57) ABSTRACT

The present invention corrects sash sag in casement windows by implementing an adjustable hinge. The adjustable hinge includes a sash arm, a support arm, a retaining clip and an adjustment mechanism. The adjustment mechanism serves a twofold purpose. First, it allows one to adjust the hinge for sash sag, and it also secures the support arm to the track of the adjustment hinge. The adjustment mechanism includes a threaded support post and a threaded member. The threaded support post has a circumferential groove which is used to receive the arms of a retaining clip. The sash arm is mounted to the track of the adjustable hinge via a shoe block. The sash arm has a protrusion located on its bottom surface. The protrusion serves as a movement restrictor.

20 Claims, 5 Drawing Sheets

ADJUSTABLE WINDOW HINGE

FIELD OF INVENTION

The present invention relates to an adjustable casement window sash, and in particular to a track and hinge assembly, that compensates sash sag, by an adjustment screw.

BACKGROUND OF THE INVENTION

Generally, casement window sashes are mounted to the window frame by hinges. These hinges may be attached either to the bottom of the window sash, or to the top of the window sash. Conversely, the hinges may be attached to both. It is typical for such a hinge to have a track mountable to the window frame. The sash arm is generally pivotally connected to a mounting shoe block, which is supported and guided, for movement lengthwise across the track. Window hinges of this type are shown, for example, in Tacheny et al. U.S. Pat. No. 4,726,093, and Sandberg et al. U.S. Pat. No. RE32,846. In normal operation when the user wishes to open a casement window, let's say, for ventilation purposes or cleaning, the user will turn a crank handle in a clockwise motion, for opening the casement window, and in a counterclockwise motion, for closing the casement window. After repeated opening and closing of a casement window, the window may eventually move out of a squared position, which in turn may prevent the window sash from fully closing, thus preventing the keeper, in the casement window frame, from engaging the latch; this can be burdensome to the user. So then, why do crank-out windows become hard to close after a few years? The answer is what is known in the window industry as "sash sag". Sash sag has been stated as "the single most asked question concerning the operating casement window today", but as research has shown there is no simple, clear cut solution to the problem. For purposes of definition, we define the problem of sash sag as the movement of the sash relative to the window frame. The first step toward gaining an understanding of sash sag is to identify the causes. One possible cause of sash sag is something that is referred to as "sash drag", whereby the sash will drag across the frame or sill as the window is opening or closing. Usually this problem is due to the bottom corner of the latch side of the sash dragging against the frame.

There are many reasons why the sash of a casement window may begin to drag against the window frame: the sash may sag out-of-square because of improper hinge positioning, improper glazing, and poor track attachment by the manufacture, or the frame may settle out of square because of poor installation.

Glazing compounds used by the manufacturers have been observed to take a considerable period of time to set up. During this time it is possible and likely for the sash to sag around the glass thereby possibly moving the sash out of square. Another cause of sash sag attributed to the manufacture is hinge positioning. This is the relationship of the top hinge to the bottom hinge and the side jamb; hinge positioning is critical in window manufacturing. Because of certain manufacturing tolerances in each hinge, there can be as much as 0.019" lateral movement of the arm assembly within the track, which will accelerate the effects of sash sag in most residential casement windows. Yet another manufacturing defect that will further accelerate sash sag is the improper fastening of the track screws. If the track screws are not driven down as straight as possible, then the track will twist over time, and cause the sash to sag. In addition, there are some types of hinges that have track protrusions which are designed to sink into soft frame materials such as wood. However, sometimes these track protrusions do not fully sink in when the screws are tightened. This condition may allow the track to shift or rotate and contribute to the sash sag. There are some tracks that have a special flat bottom hinge track, as in the present invention, specifically designed for mounting on hard frame materials.

Improper installation of the casement window is the second leading cause of sash sag, regardless of whether a frame leaves the manufacturer without any defects, and is in a square configuration or not, it must be placed into the roughed out opening and secured as squarely as possible. Any deviation from a square frame can result in apparent sash sag. In addition, casement windows which are square (shape) or wider than they are tall compound sash sag problems due to added cantilevered weight. Some experts recommend that when designing and/or specifying a casement window, the sash width should be limited to 66% of the sash height. Once again, any length discrepancies in sash or frame parts will result in the sash or frame being out of square.

Sash sag is a potential problem that requires close control at all levels of the window industry. This control must be exhibited with those who manufacture component parts as well as those who assemble, transport and ultimately install window units. Each item listed above helps add to the compounding of the sash sag problem and it is possible for one or any combination of the above problems to exist!

The earlier methods of correcting the problem of sash sag usually required that the hinge track be provided with slotted holes and that the hinge mounting screws in the slotted holes were to be removed to allow for shifting of the track. Repeated removal of such screws can, however, over the life of a window result in gradual loosening and depleted integrity of the window. In more recent times, sash sag has been corrected with the use of an adjustable hinge. One such type of adjustable hinge that has been employed is that of U.S. Pat. No. 5,152,102 and U.S. Pat. No. 5,074,075, issued to LaSee. In that prior art the inventor implemented an octagonal cam mechanism, so as to allow for sash sag compensation. More recently, U.S. Pat. No. 5,307,539, issued to Bauman, utilized an eccentric shaped adjustable stud, having a flange with surfaces for engaging an adjustment tool, having a pivot portion, about which the swivel arm pivots, and an eccentric neck, frictionally secured to the window frame or the track, about which the pivot axis rotates when the alignment is adjusted. However, this prior art required the user to engage a wrench, the adjustment tool, roughly perpendicular to the hinge axis. Because of the tight spaces associated with casement window hardware, this type of adjustment method can be unduly burdensome to the user. This stud type adjustment was improved upon in U.S. Pat. No. 5,964,011, assigned to Newell, by having the tool access position, in which the tool is engageable with the engagement stud, roughly parallel to the pivot axis. However, this type of configuration is unnecessarily complex with a multitude of different members, which may amount to possible malfunctions of the different members, and an added cost to production. In the present invention, the hinge may be adjusted simply, with the twist of screwdriver, or the simple twist of a finger. This is because of the simplified adjustment post, which consists mainly of a threaded screw and a threaded aperture.

OBJECTS OF INVENTION

It is an object of the invention to provide a casement hinge which may be easily and precisely installed.

It is another object of the invention to provide a casement hinge which will remain securely mounted and thereby minimize any loosening of the hinge over the life of the window.

It is still another object of the invention to provide a casement hinge which may be easily adjusted over the life of the window to ensure that a tight seal be provided when the window is closed and that the window be easily and smoothly operated at all times.

It is still a further object of this invention to provide a conventional casement sash unit with a screw mechanism, which is adjustable for correcting sash sag during and after installation of the casement window.

SUMMARY OF INVENTION

The present invention is deigned to compensate for sash sag in casement windows. The typical casement window has a window sash hinged to the window frame. The hinge is generally pivotally connected to a shoe block. This pivotal connection allows the window operator the ability to open and close the window sash. As in most casement windows, after repeated use the window sash may begin to sag, "sash sag". Conversely, a manufacturing defect, such as those listed above, may also cause the sash to sag. In order to correct the quandary of sash sag, previous casement windows required the relocation of the hinge tracks. However, this caused premature wear of the pivot mount and the pivot mounting hardware, thereby reducing the useable life of the casement window.

The present invention relates to an adjustable pivotally linked hinge and track system for casement windows. The hinge has a sash arm pivotally connected, via a rivet, to a shoe block, which allows for movement across the horizontal plane of a window track. The sash arm is also pivotally connected to a support arm, via another rivet. The support arm has a bored cavity used to house the adjustment mechanism. Moreover, the support arm has a slidable flexible clip that traverses across the top surface of the support arm. In addition, if needed, the support arm has a slit or groove that gives the user additional leverage when disengaging the flexible clip.

The present invention also relates to an adjustment mechanism, which includes a threaded adjustment screw having a first end constructed to receive the tip of a Philips head screwdriver, and a threaded support post capable of receiving the threaded adjustment screw. A circumferential groove is located near the top end of the threaded support post, which is capable of engaging the two opposing flexible arms of the retaining clip.

The present invention further relates to a track assembly that is mounted to a window frame. A track assembly having at least one generally circular aperture for receiving the support post of the adjustment mechanism. A track assembly having a perpendicular rear end portion that has an upper arcuate lip portion.

BRIEF DESCRIPTION OF INVENTION

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
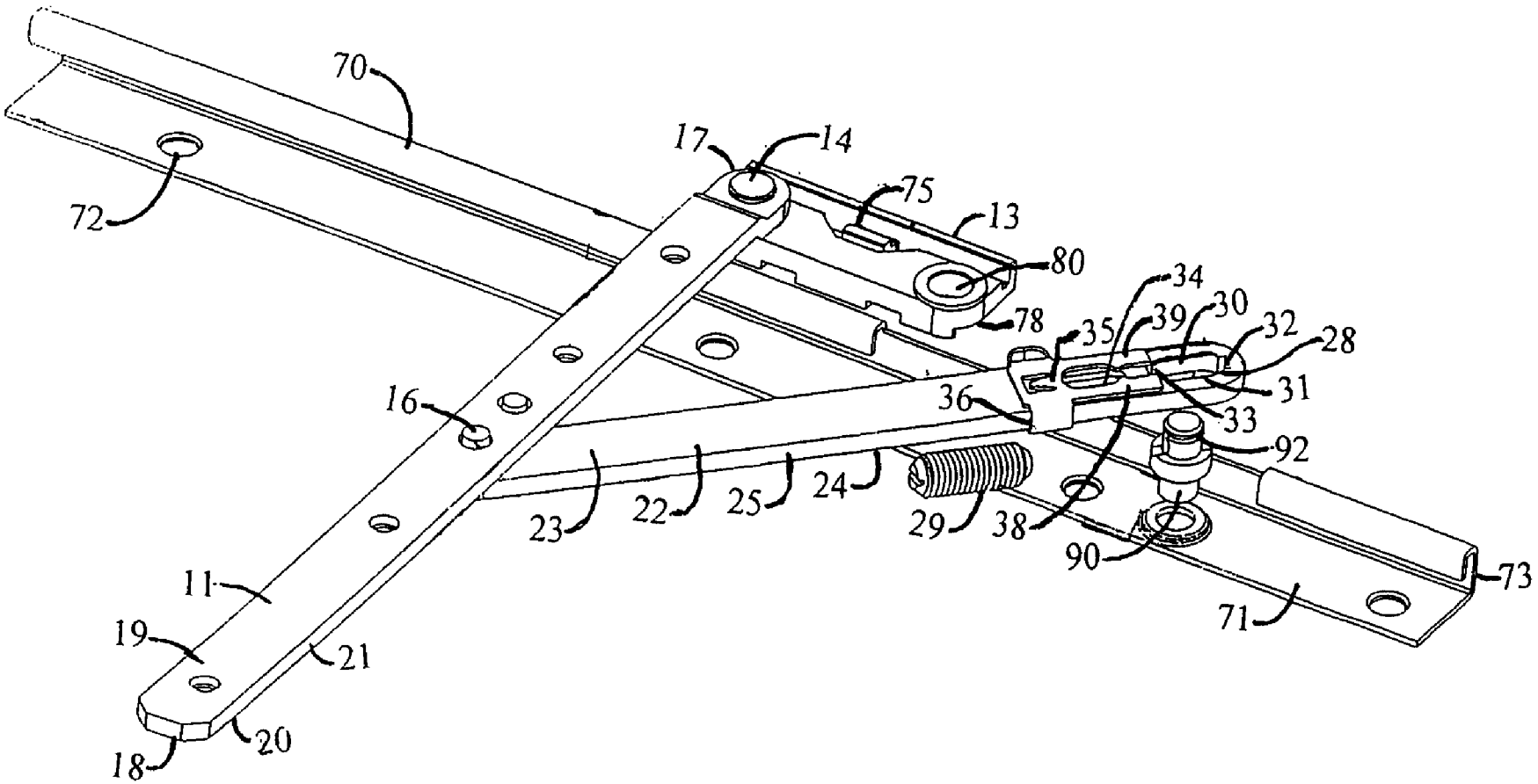
FIG. 1 is a perspective view of the window hinge of the present invention.

Referring now to the drawings, and, more specifically, to FIG. 1, sash arm 11 is used to connect casement window 10, not shown, to window sash 12, not shown. Casement window 10 is used to facilitate the opening and closing of a window sash 12. Sash arm 11 is at one end pivotally attached to shoe block 13 and is mounted along its length to the underside of window sash 12, with a fastener, any type of fastener known in the art, but not limited to a screw, nail, tack, etc. In the present embodiment a wood screw was the preferred fastener. Sash arm 11, as mentioned previously, is connected to shoe block 13 on one end by a suitable rivet 14, or the like, for pivotal connection therebetween. Rivet 14 is staked through one of two apertures 80, depending on the desired amount of window opening, and is compressed, using a suitable tool or machine, until bottom portion 81 of rivet 14 is larger then diameter of aperture 80. This type of connection will allow for sash arm 11 to pivot during normal operation. Rivet 14 may be composed of any suitable material known in the art, but not limited to metal or metal alloys, ceramic, pvc. In the present embodiment brass was the preferred material for the construction of rivet 14. In addition, sash arm 11 is pivotally connected, to an intermediate location, to one end of support arm 22 by another suitable rivet 16, connected by the same technique as rivet 14. Sash arm 11 may be any suitable shape known in the art, but not limited to a square, rectangle, etc. In the present embodiment sash arm 11 is of generally rectangular shape with generally rounded inner and outer ends, 17 and 18 respectively, as seen in FIG. 1. Outer end 18 may be crimped so as to form half of an octagon, as seen in FIG. 1. Sash arm 11 has top and bottom surfaces, 19 and 20 respectively, along with a generally circumferential side wall 21. Top surface 19 of sash arm 11 may taper downward near inner end 17 of sash arm 11, or it may be even with the plane of top surface 19. Sash arm 11 may have a dimple 21, or protrusion, on bottom surface 20. Dimple 21 may be of any suitable shape known in the art, but not limited to circle, square, rectangle, etc. In the present embodiment dimple 21 was generally cylindrical in shape. In normal operation dimple 21 will contact circumferential sidewall 25, thus preventing sash arm 11 from pivoting passed a certain point, predetermined at manufacturing. Generally, dimple 21 can be positioned on sash arm 11 so as to allow sash arm 11 to pivot from 0° to 90°.

Figure 2:
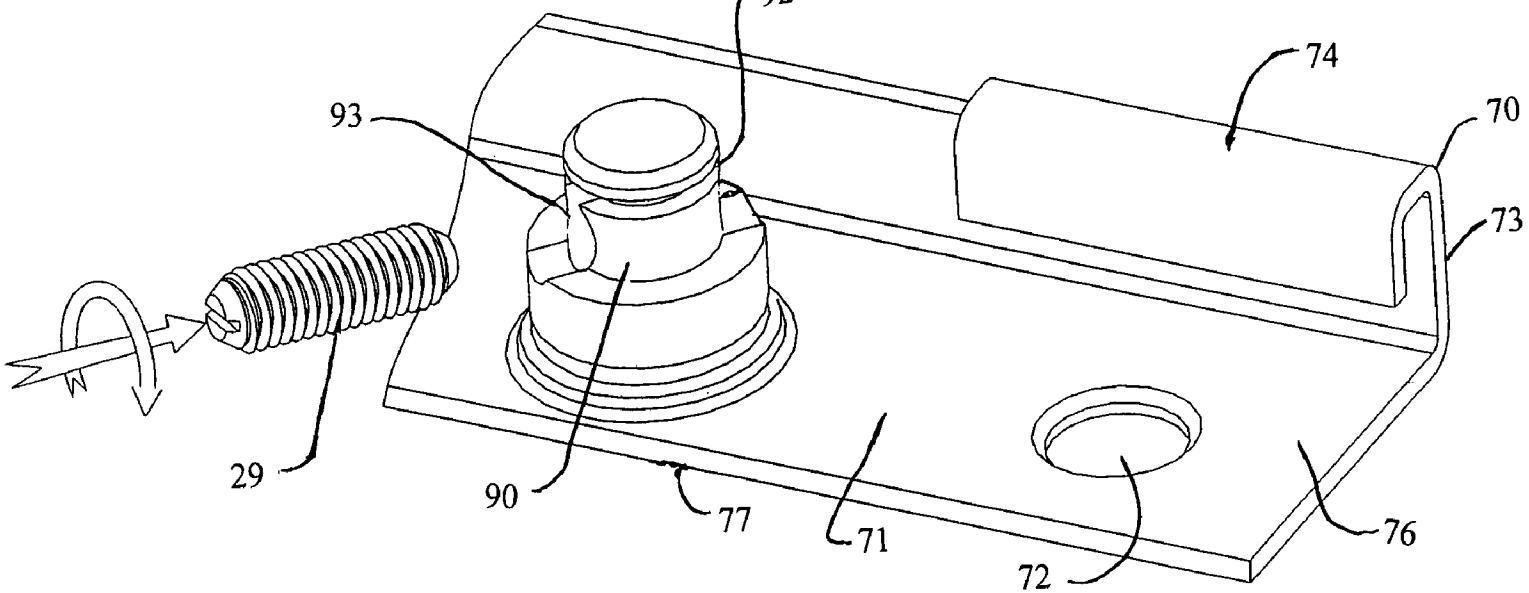
FIG. 2 is an exploded view of the adjustment mechanism of the present invention.
Figure 3:
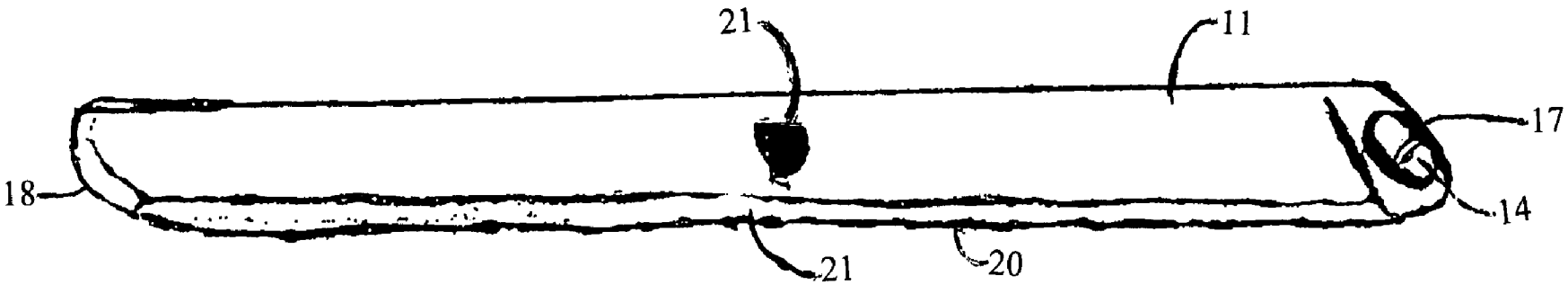
FIG. 3 is a bottom view of the sash arm of the present invention.
Figure 4:
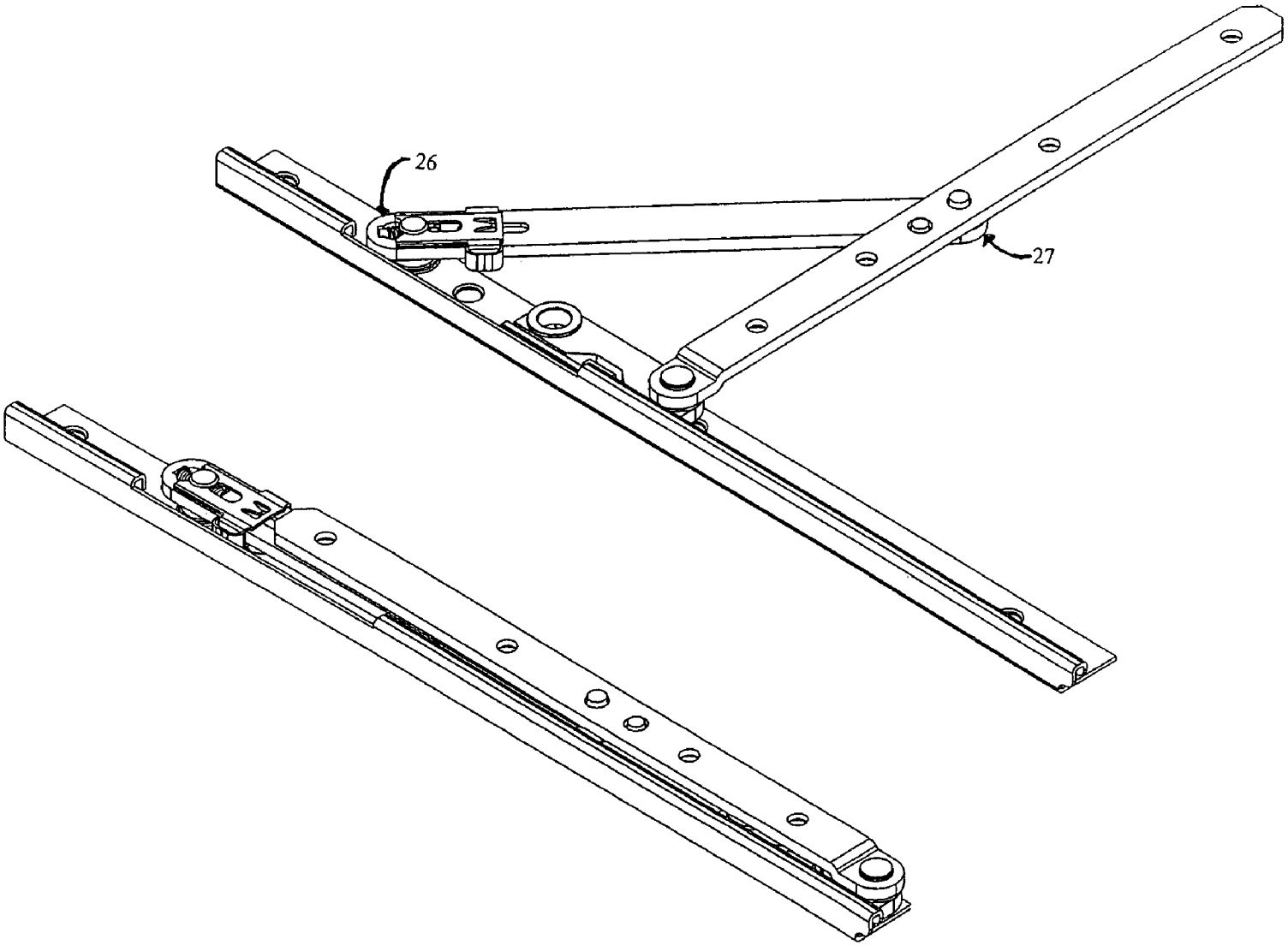
FIG. 4 is a perspective view of the window hinge in an open and closed position.
Figure 5:
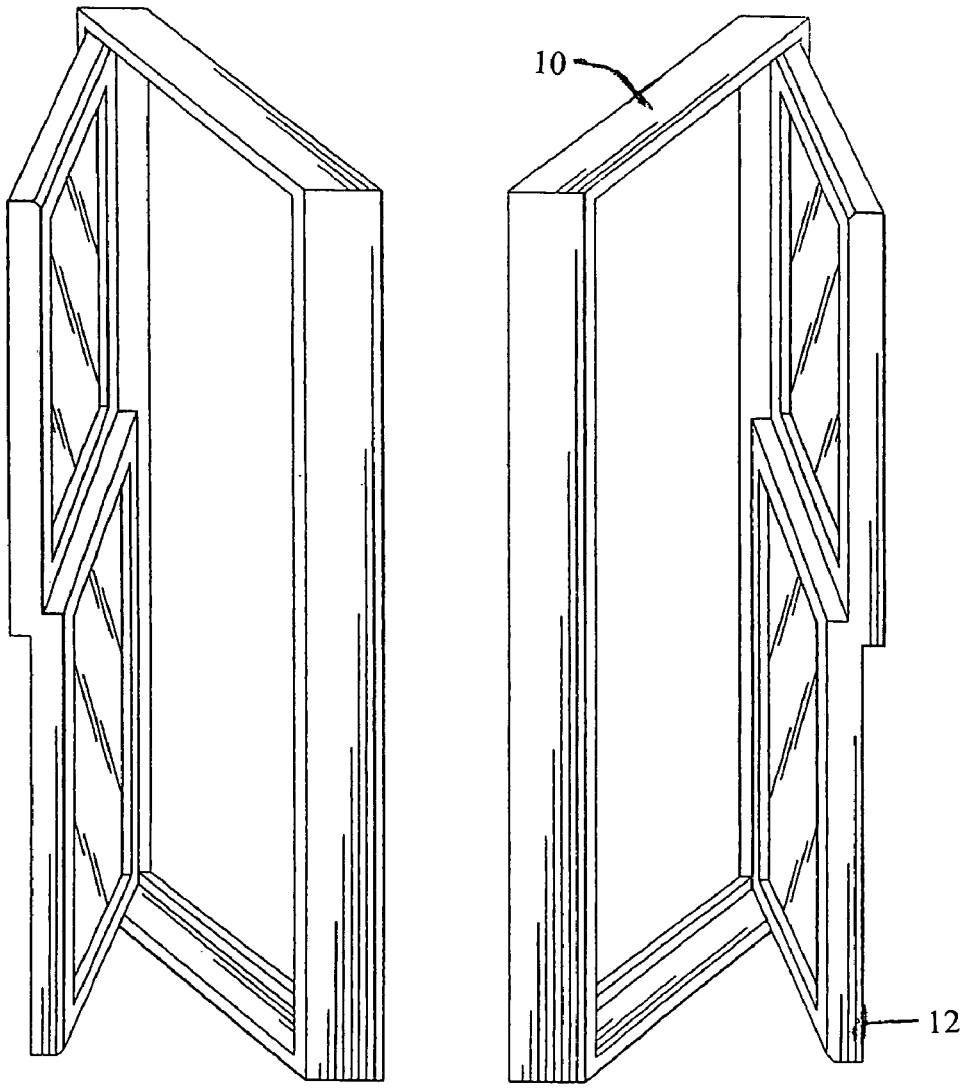
FIG. 5 is a front view of a typical casement window with a sash.

Support arm 22 may be of generally the same shape as sash arm 11, as seen in FIG. 1. Support arm 22 has top and bottom surfaces, 23 and 24 respectively, along with generally circumferential sidewall 25. Generally, support arm 22 is shorter in length then sash arm 11. Support arm 22 may have rounded inner and outer ends, 26 and 27 respectively. In addition, support arm 22 may have an aperture located near outer end 27, so as to allow for a pivotal connection between support and sash arm 22, as mentioned above. Furthermore, near inner end 26 there may be a bored cavity 28 to house post 90 and screw 29; bored cavity 28 may be of any general shape known in the art, but not limited to a circle, square, rectangle, etc. In the present embodiment the preferred shape was that of screw 29, i.e. screw like, as seen in FIGS. 1 and 2. Bored cavity 28 has sidewalls 30 and 31, along with front and rear walls 32 and 33 respectively. Support arm 22 may have a slit 34 adjacent to bored cavity 28. Slit 34 may be used if additional leverage is needed to detach retaining clip 35 from adjustment mechanism 29. Slit 34 may be of any suitable shape known in the art, but not limited to circular, oval, or shape. It must be pointed out that both sash arm 11 and support arm 22 may be constructed of any suitable material known in the art but not limited to metal or metal alloy, wood, polyvinyl chloride (pvc), etc. In the present embodiment the preferred material was metal.

Retaining clip 35 may be constructed of any suitable material known in the art but not limited to metal or metal alloy, wood, polyvinyl chloride (pvc), etc. In the present embodiment the preferred material was a resilient type of metal, so as to allow for engaging support post 90. Retaining clip 35 is slidably interconnected with support arm 22. Retaining clip 35 has roughly "C" shaped edges 36 that hold retaining clip 35 to support arm 22 while allowing retaining clip 35 to traverse along support arm 22 when retaining clip 35 is disengaged from support post 90. In addition, retaining clip 35 has a pair of flexible opposed arms, 38 and 39 that, when pressed against support post 90, engage groove 92, by means of a friction or pressed fit.

Track 70 may be constructed of any suitable material known in the art, but not limited to metal or metal alloy, ceramic, polyvinyl chloride (pvc), etc. In the present embodiment the preferred material for the construction of track 70 was metal. Track 70 may be composed of a generally horizontal elongated track portion 71, having a plurality of longitudinally spaced apertures 72 therein, through which project fasteners for mounting horizontal track portion 71 to window opening, any suitable type of fastener known in the art but not limited to a screw, nail, tack may be used. In the present embodiment the preferred fastener was wood screws. Horizontal track portion 71 may be generally rectangular in shape, as in the present embodiment, but any suitable shape known in the art may be used. In addition horizontal portion 71 has top and bottom surfaces, 76 and 77 respectively. In one embodiment track 70 also may have a vertical portion 73, which may be perpendicular to horizontal elongated track portion 71, so as to form a right angle with horizontal track portion 71. Vertical portion 73 may have an arcuate lip 74 which may be integrally formed therewith and may traverse longitudinally from one end of track 70 to a point located passed the mid-portion of track 70. Arcuate lip 74 acts as a guide for shoe block 13, and thus allows shoe block 13 to slide across horizontal portion 71 in a uniform fashion, and retain shoe block 13 thereto.

In yet another embodiment horizontal track 70 may not have a vertical portion, but rather horizontal track portion 71, may have a rib located on top surface 76 of horizontal track portion 71, and a parallel groove on the base of shoe block 13. In that embodiment shoe block 13 would traverse along the rib of horizontal surface 76.

Shoe block 13 may be of any suitable shape known in the art but not limited to a square, rectangle, and triangle. In the present embodiment the preferred shape for shoe block 13 was a generally rectangular shape with rounded outside corners 78. In addition, show block 13 may be constructed from any suitable material known in the art but not limited to metal or metal alloy, plastic, glass filled nylon or any equivalent. In the present embodiment the preferred material for construction of shoe block 13 was plastic. Shoe block 13 has a keeper arm 75 that traverse longitudinally across back edge 76 of shoe block 13. Shoe block 13 may be constructed with a plurality of apertures. In the present embodiment shoe block 13 has two circular apertures 80 located near outside corners 78. As mentioned previously shoe block 13 is pivotally connected to sash arm 11 by rivet 14. Rivet 14 is staked through one of apertures 80, depending on the desired amount of windowing opening, and is compressed, using a suitable tool or machine, until bottom portion of rivet 14 is larger than the diameter of aperture 80. This type of connection will allow for sash arm 11 to pivot during normal operation. Shoe block 13 may be reinforced with additional material for added strength and longer use. In the present embodiment shoe block 13 has two pieces of reinforcing metal located inside of shoe block 13, underneath apertures 80.

As mentioned previously support post 90 and threaded adjustment screw 29, are located on top surface 76 of horizontal track portion 70, fixed at a position that will allow for optimum performance of hinge. Support post 90 may be a generally cylindrically shaped rivet, but any suitable shape known in the art may be used. In one embodiment support post 90 may have a generally concave bored portion on outside surface. Support post 90 may be composed of any suitable material known in the art, but not limited to metal or metal alloys, ceramic, pvc, etc. In the present embodiment the preferred material for construction of support post 90 was brass. Support post 90 may be connected to horizontal surface 70 in the same manner as rivet 14. Support post 90 may have a circumferential groove 92 located on the outside top surface 91, for engaging flexible arms 38 and 39. In addition an aperture 93 may be located near the center of support post 90, for receiving adjustment screw 29; aperture 93 may be threaded, or smooth, depending on the screw type. Adjustment screw 29 may be of any suitable shape type known in the art, in the present embodiment an adjustment screw 29 with crossed slots capable of accepting a Philips head screwdriver, was preferred. One could also have used a variety of other suitable types of screws known in the art, but not limited to a single slot type screw to accept a flat head screw driver, or hexagonal aperture to accept an Allen wrench, etc. Furthermore, one may use a knurled or square head style screw rather than a screw that requires a tool for rotation. With that embodiment, in normal operation, one could use the surface of ones finger to adjust the screw. Screw 29 of the present invention may be situation inside of bored cavity 28 so that the area of screw 29 that accepts the tool, or in the case of a knurled screw, the finger is placed adjacent to front wall 32 of bored cavity.

The functionality of the hinge of the present invention is as follows. As mentioned above, sometimes casement windows will begin to sag, "sash sag". This sag may occur before or after installation. Conversely, sash sag may occur after repeated use of the window 10, i.e. opening and closing. In order to compensate for the sag the user will open window 10 so as to allow sash 12 to be fully extended outward. The user will then apply a force to retaining clip 35, which will disengage retaining clip 35 from circumferential groove 92. This will allow the user the capability of raising support arm 22 over adjustment screw 29, and thus, allowing access to adjustment mechanism 29. Once the user has access to screw 29, the user can easily turn screen 29 to compensate for the unwanted sash sag. After the adjustment has been made, the user will then return support arm 22 back over adjustment screw 29, and press retaining clip 35 back around circumferential groove 92.

In the view above it will be seen that several objects of the invention are achieved and other advantageous results attained.

As various changes could be made in the above constructions without departing from the scope of the invention, it is intended that all matter contained in the above description shall be interpreted as illustrative and not in a limiting sense.

We claim:

1. An improved hinge assembly for casement windows said hinge assembly comprising: a track; a shoe having a portion thereof that is adapted to slidably travel along a top surface of said track; a post being pivotally affixed and extending therefrom, said post comprising a cylindrical surface formed about an axis and having a first end and a second end, said post having a cylindrical orifice bored transverse through said cylindrical surface and being internally threaded to receive an externally threaded adjustment member; a sash arm extending from said shoe and which has a first end pivotally mounted thereto; and a support arm that has a first end and a second end; said support arm further comprising a top and a bottom surface joined by two side surfaces, said top surface of said support arm having a width, said side surface of said support arm having a height smaller than said width of said top surface of said support arm; said second end of said support arm further comprising a slotted opening having a depth which extends through said arm from said top surface of said support arm to said bottom surface of said support arm, said slotted opening having a length defined by two end surfaces, and a width defined by two lateral surfaces; said length and said width permitting said support arm to receive said threaded adjustment member and said cylindrical post in said slotted opening; said first end of said support arm being pivotally connected to said sash arm at a first pivot point, and said second end of said support arm being pivotally connected to said post to form a second pivot point at post axis, said first pivot point of said support arm being adjustable relative to said second pivot point.

2. The improved hinge assembly of claim 1 wherein said support arm has a length from said first pivot point to said second pivot point, and wherein said length is adjusted by rotating or counter-rotating said threaded member.

3. The hinge assembly according to claim 2 wherein a locking member is slidably mounted to said support member, said locking member further comprising a pair of flexible arms that engage an annular groove in said post to releasably secure said second end of said support arm to said post.

4. The hinge assembly according to claim 3 wherein said post has a flange extending circumferentially from said post.

5. The hinge assembly according to claim 4 wherein said locking member has a top surface and a bottom surface, said bottom surface of said locking member contacts the top surface of said support arm, said locking member having a first flange and a second flange that contact the bottom surface of said support arm to slidably secure said locking member to said support arm.

6. The hinge assembly according to claim 5 wherein said sash arm has a protrusion extending from a surface for preventing said sash arm from pivoting more than a predetermined amount.

7. The hinge assembly according to claim 6 wherein said support arm and said sash arm have a top surface and a bottom surface and wherein the top surface of said support arm is pivotally connected to the bottom surface of said sash arm.

8. The hinge assembly according to claim 7 wherein said first end of said threaded member is adapted to receive an instrument to rotate said threaded member and advance said threaded member through said threaded orifice of said post.

9. An adjustable casement window hinge assembly, said hinge assembly providing multi-directional window adjustments relative to a master frame, said hinge assembly comprising:

(a) a track member; said track member comprising a mounting flange with a channel connected thereto, said channel spanning at least a portion of said track member; said mounting flange having one or more mounting orifices;

(b) a shoe, said shoe being adapted to travel upon said mounting flange with at least a portion of said shoe being slidably retained within said channel;

(c) a cylindrical post, said post having a length defined by a first end and a second end, and a generally constant diameter about an axis; said cylindrical post having an annular flange between said first end and said second end with a top flange face and a bottom flange face; said first end of said post being pivotally installed in an orifice in said mounting flange wherein said bottom face of said annular flange contacts said mounting flange; said second end of said post having a cross-wise aperture, said cross-wise aperture being internally threaded;

(d) an adjustment screw, said adjustment screw having a length greater than said diameter of said post; said adjustment screw being rotatably installed into said internally threaded post aperture; said adjustment screw having at least one end adapted to receive a tool capable of applying a torque to cause rotation or counter-rotation thereof;

(e) a support arm, said support arm having a first end and a second end, and having a top surface and a bottom surface; said first end comprising a race-track shaped opening with a length approximately as long as said adjustment screw length, and a width sized to permit installation of said first end onto said cylindrical post with said bottom surface of said support arm contacting said top face of said annular flange; said adjustment screw nesting inside said race-track opening and causing said support arm to synchronously pivot with said post about said axis;

(f) a clip for removably securing said support arm to said post; said spring clip being slidably attached to said top surface of said support arm; said clip comprising a pair of flexible arms being removably securable to an annular groove in said post;

(g) a sash arm, said sash arm having a top surface and a bottom surface, and having a first end and a second end; said first end of said sash arm being pivotally mounted to ;aid shoe and having a joggled step; said second end of said support arm being pivotally connected to said sash arm at a location between said joggled step and said second end of said sash arm to thereby cause said travel of said shoe relative to said track member; said shoe travel causing travel of said sash arm;

(h) wherein said travel of said sash arm is relative to said track member and comprises pivotal and translational motion in moving from a closed to an open position; said closed position comprising said sash arm and said support arm being approximately in line; said travel into said open. position being limited by a dimple on said sash arm wherein said dimple contacts said support arm to inhibit sliding movement of said shoe in said track member when said sash arm is at approximately a 90 degree angle to said track member; said pivotal motion of said sash arm occurring at said pivotal connection to said support arm, said pivotal motion being about said post axis; said pivoting being at a radius defined by an adjustable distance between said pivotal connection to said sash arm and said post axis;

(i) wherein said adjustable distance is modified by rotation or counter-rotation of said adjustment screw to change said pivoting radius;

(j) wherein said counter-rotation of said adjustment screw causes said pivoting radius to be increased by causing said sash-arm-to-support-arm pivotal connection to increase in distance from said post axis, said counter-rotational adjustment comprising: removal of said clip; removing said support arm from said post; said counter-rotating of said adjustment screw; reinstalling said support arm; and re-securing said reinstalled support arm with said clip; and (k) wherein said rotation of said adjustment screw causes said pivoting radius to be decreased by causing said sash-arm-to-support-arm pivotal connection to decrease in distance from said post axis, said rotational adjustment comprising: removal of said clip; removing said support arm from said post; said rotating of said adjustment screw; reinstalling said support arm; and securing said reinstalled support arm with said clip.

10. In combination, a pair of improved hinge assemblies and a casement window, said window being secured to said pair of hinge assemblies, said pair of hinge assemblies comprising an upper hinge assembly and a lower hinge assembly installed in a master window frame, said hinge assemblies being capable of providing multi-directional adjustments to said casement window relative to said master frame;

said lower hinge comprising a track; a shoe having a portion thereof adapted to slidably travel along a top surface of said track; a post having a cylindrical surface formed about an axis and having a first end and a second end, said post having a portion pivotally installed in said top surface of said track, said post having a cylindrical orifice bored transverse to said cylinder axis, said orifice being internally threaded to receive an externally-threaded cylindrical adjustment member, said adjustment member having a first end and a second end; a sash arm extending from said shoe and having a first end pivotally affixed thereto; a support arm having a first end and a second end, and a top and a bottom surface; said first end of said support arm further comprising a slotted opening, said slotted opening having a length defined by two end surfaces, and a width defined by two lateral surfaces; said sash arm first end further comprising a joggled step, said joggled step permitting said sash arm bottom surface to be pivotally connected to top surface of said support arm at said second end; said first end of said support arm adjustably pivoting about said post axis, said adjustable pivoting causing said pivotal connection between said support arm and said sash arm to pivot at an adjustable distance from said post axis;

said upper hinge being constructed the same as said lower hinge but being a mirror image opposite construction of said lower hinge;

said casement window being attached at each end thereof to said upper and lower hinge assemblies using fasteners through a plurality of orifices in each of said respective sash arms;

and wherein adjustment of said casement window relative to said master fame is by a first adjustment being to said upper hinge assembly to modify said adjustable pivoting distance from said respective post axis, and a second adjustment being to said lower hinge assembly to modify said adjustable pivoting distance from said respective post axis, said first and second adjustments operating to counter sash sag.

11. The hinge assembly according to claim 10 wherein said first adjustment to said upper hinge and said second adjustment to said lower hinge counters said sash sag wherein said sash sag comprises of an out-of-square casement window frame.

12. The hinge assembly according to claim 11 wherein said adjustments counter said out-of-square frame by loading said upper casement frame portion relative to said lower casement frame portion.

13. An adjustable hinge assembly, for use in casement windows, said hinge assembly providing multi-directional window adjustments relative to a master frame, said hinge assembly comprising:

(a) a track member; said track member comprising a mounting flange with a channel connected thereto, said channel spanning at least a portion of said track member; said mounting flange having one or more mounting orifices;

(b) a shoe, said shoe being adapted to travel upon said mounting flange with at least a portion of said shoe being slidably retained within said channel;

(c) a cylindrical post, said post having a length defined by a first end and a second end, and a generally constant diameter about an axis; said cylindrical post having an annular flange between said first end and said second end with a top flange face and a bottom flange face; said first end of said post being pivotally installed in an orifice in said mounting flange wherein said bottom face of said annular flange contacts said mounting flange; said second end of said post having a cross-wise aperture, said cross-wise aperture being internally threaded;

(d) an adjustment screw, said adjustment screw having a length greater than said diameter of said post; said adjustment screw being rotatably installed into said internally threaded post aperture;

(e) a support arm, said support arm having a first end and a second end, and having a top surface and a bottom surface; said first end comprising a race-track shaped opening with a length approximately as long as said adjustment screw length, and a width sized to permit installation of said first end onto said cylindrical post with said bottom surface of said support arm contacting said top face of said annular flange; said adjustment screw nesting inside said race-track opening and causing said support arm to synchronously pivot with said post about said axis;

(f) a clip, said clip being adapted for repeatedly securing said support arm to said cylindrical post;

(g) a sash arm, said sash arm having a top surface and a bottom surface, and having a first end and a second end; said first end of said sash arm being pivotally mounted to said shoe; said second end of said support arm being pivotally connected to said sash arm at a location between said first and second ends of said sash arm to thereby cause said travel of said sash arm relative to said track member; and (h) wherein said travel of said sash arm relative to said track member comprises pivotal and translational motion, said pivotal motion of said sash arm occurring at said pivotal connection to said support arm and being about said post axis; said pivoting being at an adjustable radius defined by a distance between said pivotal connection to said sash arm and said post axis; said radius being adjusted by increasing or decreasing said distance through counter-rotation or rotation of said adjustment screw.

14. The hinge assembly according to claim 13 wherein said counter-rotation of said adjustment screw causes said pivoting radius to be increased; said adjustment screw counter-rotation causing said sash-arm to-support-arm pivotal connection to increase in distance from said post axis.

15. The hinge assembly according to claim 14 wherein said counter-rotational adjustment of said hinge assembly comprises: removal of said clip; removing said support arm from said post; said counter-rotating of said adjustment screw; reinstalling said support arm; and securing said reinstalled support arm with said clip.

16. The hinge assembly according to claim 13 wherein said rotation of said adjustment screw causes said pivoting radius to be decreased; said adjustment screw rotation causing said sash-arm-to-support-arm pivotal connection to decrease in distance from said post axis.

17. The hinge assembly according to claim 16 wherein said rotational adjustment of said hinge assembly comprises: removal of said clip; removing said support arm from said post; said rotating of said adjustment screw; reinstalling said support arm; and securing said reinstalled support arm with said clip.

18. The hinge assembly according to claim 17 wherein said adjustment screw comprises an end adapted to receive a tool, said tool capable of applying a torque to cause rotation or counter-rotation of said adjustment screw.

19. The hinge assembly according to claim 18 wherein said clip comprises a C-shape that is slidably mounted onto said support arm, and wherein said C-shape further comprises a pair of flexible arms that engage an annular groove on said post by snapping thereon for repeatable securing of said clip to said post.

20. The hinge assembly according to claim 19 wherein said sash arm travel into said open position is limited by a dimple on said sash, wherein said dimple contacts said support arm to inhibit sliding movement of said shoe in said track member.

* * * * *